United States Patent [19]

Ito et al.

[11] 4,111,116

[45] Sep. 5, 1978

[54] APPARATUS FOR CLAMPING AND BINDING A STACK OF PAPER

[75] Inventors: Yukio Ito, Fujisawa; Susumu Morishima, Kamakura, both of Japan

[73] Assignees: Hitachi Denshi Engineering Kabushiki Kaisha; Musashi Kabushiki Kaisha, Tokyo, both of Japan

[21] Appl. No.: 789,280

[22] Filed: Apr. 20, 1977

[30] Foreign Application Priority Data

Apr. 27, 1976 [JP] Japan ..... 51-47211

[51] Int. Cl.[2] ..... B30B 15/06

[52] U.S. Cl. ..... 100/281; 53/586; 100/3; 100/27; 100/295; 156/581

[58] Field of Search ..... 53/3, 124 D, 24, 198 R; 156/475, 581; 100/3, 27, 28, 33 PB, 33 R, 295, 7, 280, 281

[56] References Cited

U.S. PATENT DOCUMENTS

| | | | |
|---|---|---|---|
| 1,665,730 | 4/1928 | Chase | 100/3 |
| 1,875,260 | 8/1932 | Parker | 100/28 |
| 2,982,063 | 5/1961 | Coleman | 53/198 R |
| 3,604,182 | 9/1971 | Jepsen | 53/124 D |
| 3,826,896 | 7/1974 | Thompson | 100/295 |
| 4,014,731 | 3/1977 | Muto | 53/198 R |

FOREIGN PATENT DOCUMENTS

| | | | |
|---|---|---|---|
| 1,381,075 | 10/1964 | France | 53/24 |

*Primary Examiner*—Billy J. Wilhite

*Attorney, Agent, or Firm*—Wenderoth, Lind & Ponack

[57] ABSTRACT

Disclosed is an apparatus for holding a stack of papers such as paper money in a compressed state before and during the winding of a binder tape around the stack to form a bound paper bundle. The apparatus comprises first and second bases or platforms longitudinally aligned to each other with a gap interposed therebetween. Each of the platforms is in the upper surface thereof formed with an arcuately concaved longitudinal recess which is adapted to be covered by resilient plate for receiving thereon the stack of papers to be bound. Disposed above the first and second platforms is a vertically movable pressing pad plate which has an arcuately convexed lower surface. The stack of papers placed on the resilient plate can thus be clamped between the platforms and the lowered pressing pad and held in the arcuately compressed state.

5 Claims, 5 Drawing Figures

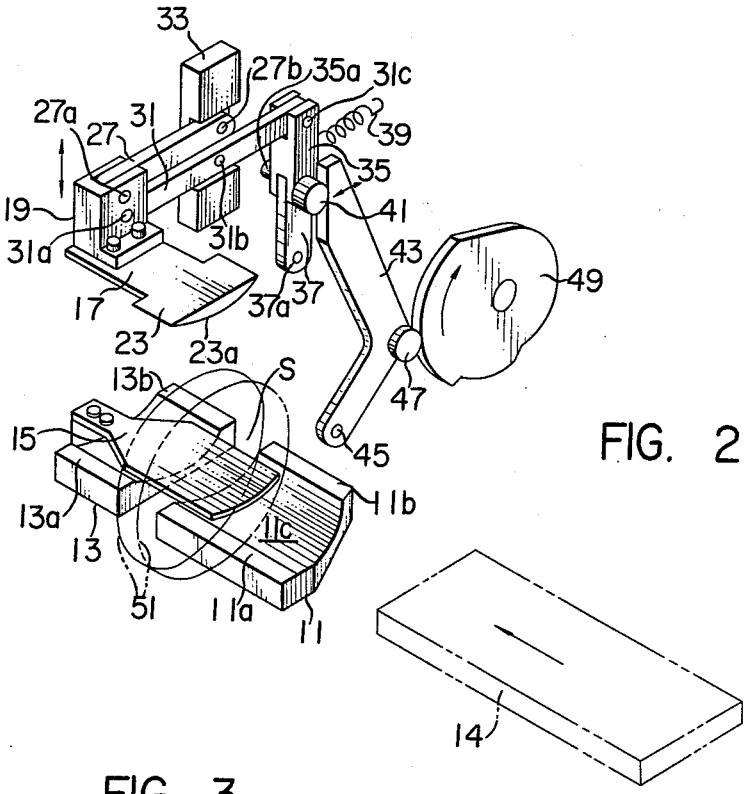
FIG. 2
FIG. 3
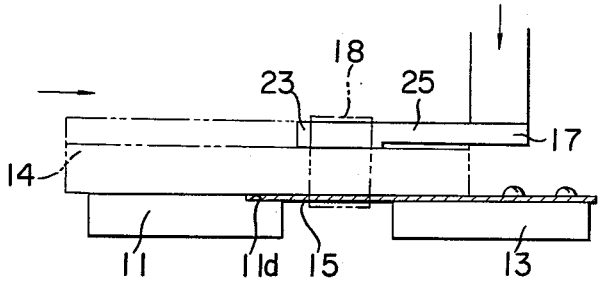
FIG. 4
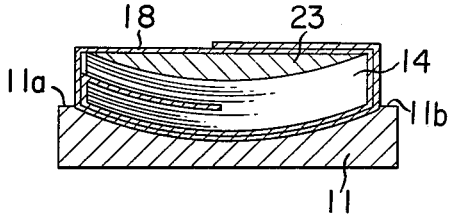
FIG. 5
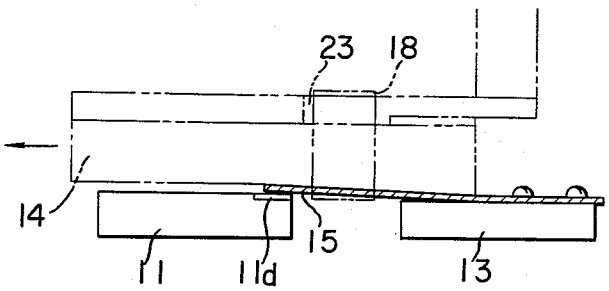

APPARATUS FOR CLAMPING AND BINDING A STACK OF PAPER

BACKGROUND OF THE INVENTION

The present invention relates in general to an apparatus for binding a bundle of paper sheets such as paper money, by winding a binder tape or strip around the paper stack, and in particular to a clamping apparatus for holding the paper stack to be bundled in a pressed or compacted state before and during the tape-winding operation.

In some industrial fields, a plurality of paper sheets are bound or bundled by winding a binder tape or band around a stack of paper sheets, such as paper money, for example. In the process of this winding operation, the binder tape or strip is at first fed from a supply roll and the leading or forward end portion of the tape is inserted in the stack of paper sheets. Thereafter, the tape is wound around the paper stack a desired number of turns and finally the trailing end portion of the tape is cut and bonded to the tape portion wound around the paper stack. An important matter in this bundling operation is to positively and securely bind together the paper stack, thereby preventing the possibility of the bound paper stack from afterward being loosened. In order to inhibit some leaves from being accidentally withdrawn from the bundled paper stack, it is required that the winding tape be wound around the paper stack while the latter is held in a considerably compressed state. In general, a loose stack of paper sheets such as paper money is bulged and has a greater apparent thickness than the net thickness. Under such these loose conditions, the binding of the paper stack will not result in a fixedly and securely bundled paper stack. With a view to avoiding such disadvantages, it has been contemplated that a stack of paper sheets to be bound together maybe held in a forcibly compressed or compacted state during the binding operation. Further, it may occur for those skilled in the art that the paper stack is maintained in a distorted state, e.g. arcuately bent state and the restoring tendency of the bound paper stack from such distorted state to the original flat state after the binding operation is utilized for imparting tension to the bundled paper stack. However, there has hithertofore been proposed no satisfactory apparatus, the operations of which well meet the above requirements.

SUMMARY OF THE INVENTION

Accordingly, an object of the invention is to provide an apparatus for maintaining a stack of paper sheets to be boundled in a compressed and distorted state which is very effective to produce a securely and positively bundled stack of paper sheets with a simple and rigid construction.

With the above object in view, there is proposed in accordance with a feature of the invention an apparatus for holding a stack of papers, such as paper money, in a compressed state before and during the winding of a binder tape around the stack to form a bound paper bundle. The apparatus comprises first and second bases or platforms longitudinally aligned to each other with a gap interposed therebetween. Each of the platforms is in the upper surface thereof formed with an arcuately concaved longitudinal recess which is adapted to be covered by a resilient plate for receiving thereon the stack of papers to be bound. Disposed above the first and second platforms is a vertically movable pressing pad plate which has an arcuately convexed lower surface. The stack of papers placed on the resilient plate can thus be clamped between the platforms and the lowered pressing pad and held in the arcuately compressed state. Thereafter, the binding tape is wound around the paper stack, as well as the pressing pad and the resilient receiving plate through the gap. When the tape winding has been completed, the pressing pad is lifted and the bound paper bundle can be withdrawn. The thus-bound paper stack tends to restore to its original flat state from the arcuately curved configuration imparted during the clamping operation. Such a restoring tendency in turn will contribute to maintain the bundled paper stack in a tensioned state.

BRIEF DESCRIPTION OF THE DRAWINGS

The invention will become more readily apparent from the following description of a preferred embodiment thereof shown, by way of example only, in the accompanying drawings in which:

FIG. 2 is a perspective view of a paper stack clamping or pressing apparatus constructed in accordance with an embodiment of the invention;

FIG. 3 illustrates the relationship between a paper stack pressing pad plate and a paper stack receiving plate constituting parts of the pressing apparatus shown in FIG. 2 in a state after the tape winding operation has been completed;

FIG. 4 is a partially enlarged sectional view showing a state of the bound paper stack after the tape winding operation has been completed; and FIG. 5 illustrates a positional relationship between the pressing pad plate and the paper stack receiving plate in a position in which the former is raised for a short distance, thereby allowing the withdrawal of the bundled paper stack.

DETAILED DESCRIPTION OF THE PREFERRED EMBODIMENT

Figure 1:
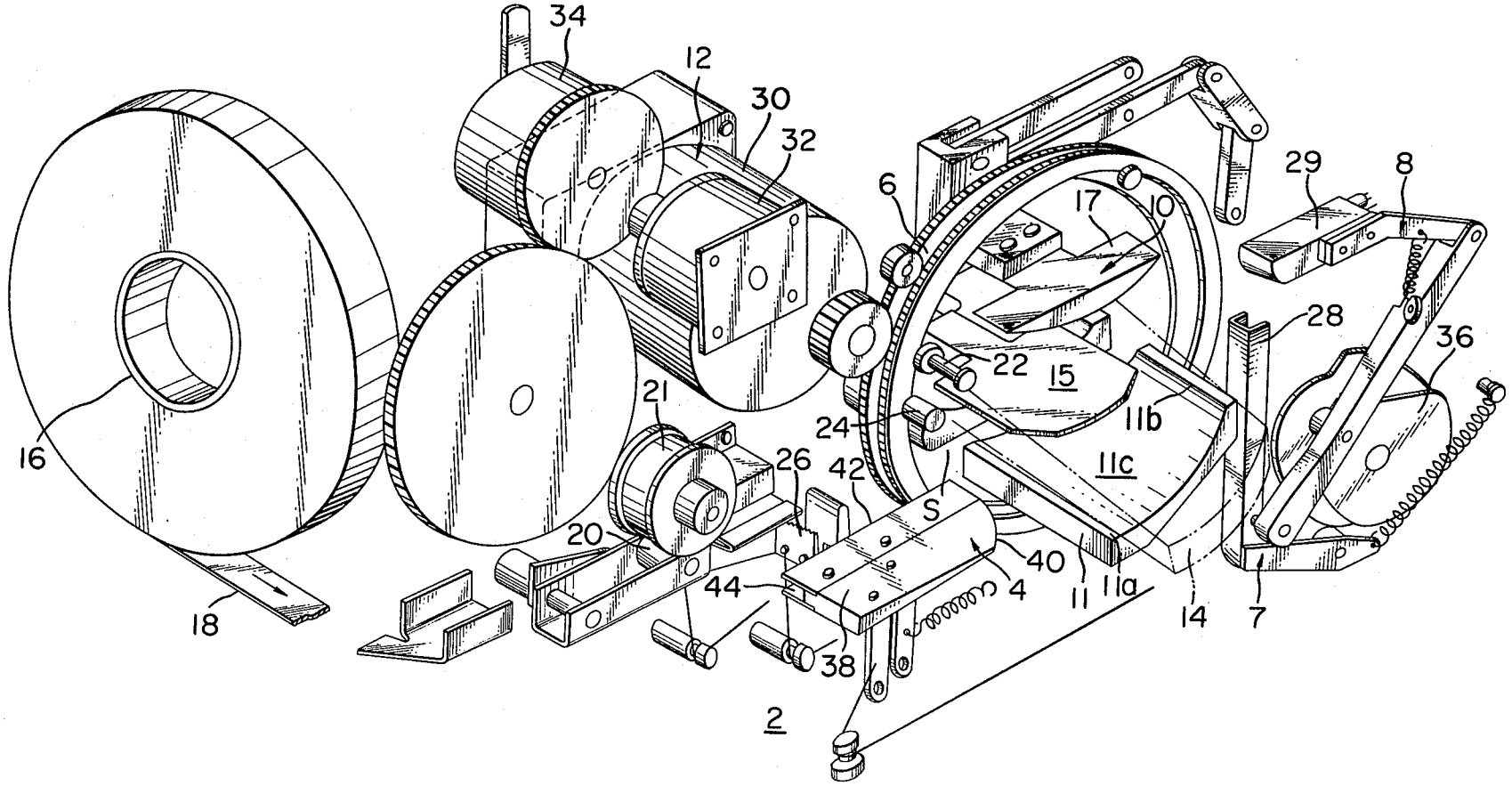
FIG. 1 is a partially exploded perspective view showing a general arrangement of a paper stack binding apparatus which may incorporate therein an apparatus for pressing or clamping a stack of papers to be bound in accordance with the teachings of the invention.

In the first place, the invention will be described with reference to FIG. 1 which shows an exemplary embodiment of the paper bundle binding apparatus constructed in accordance with the present invention.

Referring to FIG. 1, there shown schematically is the general arrangement of the paper bundle binding apparatus for binding a stack of paper sheets such as paper money. The binding apparatus generally denoted by reference numeral 2 comprises a divider unit 4 for forming a gap in a loaded stack on a bundle 14 of papers such as paper money; a flyer assembly 6 for winding a binder tape or band 18 around a paper sheet bundle; a press unit 7 for pressing the end portion of the binder tape to the wound tape portion; a sealing unit or assembly 8 for bonding the pressed end portion of the binder tape to the wound portion; a clamping unit 10; a driving unit 12; a tape feeding or dispensing unit 20; and a tape cutting unit 26.

When a bundle 14 of stacked paper sheets; such as paper money, is to be bound with the aid of the binder apparatus 2 shown in FIG. 1, the divider unit 4 is first moved from a position shown in solid lines in FIG. 1 to a position in a path along which the paper stack or bundle 14 is fed, as the result of which a gap is produced in the paper stack 14. A preferably heat sensitive binding tape or strip 18 wound around a supply reel 16 in a form of roll is then drawn or dispensed. The leading end portion of the binder tape or band 18 is fed along a predetermined path by means of a pinch roller 20 and a feeding roller 21 and is inserted into the gap space produced in the stack of papers. When the binder band 18 has thus been properly placed, the bundle of the paper stack 14 is subjected to a clamping force by the clamping mechanism 10. Thereafter, the binder tape 18 is nipped between a pair of pins 22 and 24 of the band winding unit 6 which are rotatable relative to each other. When the band winding unit 6 is revolved with the binder tape or band 18 being in the nipped state, the latter is wound around the bundle of the paper stack 14 (refer to FIG. 4). When a predetermined length of the binding tape 18 has been wound around the paper bundle, the cutter or knife 26, which may be of any suitable conventional type, is actuated upwardly to cut the tape 18, and the paper bundle is prevented from becoming loosened by means of a pressing lever 28. Subsequently, the end portions of the tape or band 18 as cut is then bonded to the wound tape portion under the action of a bonding pad 29. The paper stack 14 thus having been completely bound is then discharged from the apparatus 2.

The above operations of the binder apparatus is effected by the driving unit or mechanism 12 comprising a motor 30, a braking means 32 and a clutch 34. Further, the timing required in the above outlined operations of the binder apparatus 2 is effected with the aid of a cam assembly 36 which is adapted to be driven also by the driving means 12 and is shown only partially in FIG. 1 for simplification of the figure. Although the paper bundle or stack 14 is shown as fed into the binder apparatus 2 in the substantially horizontal position, it will be appreciated that the paper stack 14 may be inserted in a slightly or considerably inclined state so that the loading of the paper stack 14 may be facilitated. In such case, the associated individual units or mechanisms as described above will be disposed in correspondingly inclined positions.

The divider unit 4 for forming a gap in the paper stack 14 to receive the leading end portion of the binder tape 18 comprises a block 38 having a substantially plane knife edge 40 which is thinned and bent in a quadrant arcuate form and extends in the direction perpendicular to the path along which the paper stack 14 is loaded. Mounted at the rear side of the block 38 are a pair of plates 42 and 44 which extend parallel to each other for guiding the binding tape 18. In this connection, it should be mentioned that the divider unit 4 described above may be constructed similar to the one disclosed in a copending U.S. Patent Application Ser. No. 789,274 of Yukio Ito et al, filed on Apr. 20, 1977 under the title of "APPARATUS FOR BINDING PAPER STACK" which corresponds to Japanese Patent Applications Nos. 47208/1976 and 47212/1976 and has been assigned to the same assignees as the present application. Additionally, the binding tape dispensing and dealing apparatus 6 described above may be constructed similar to the one disclosed in a copending U.S. Patent Application Ser. No. 791,150 of Yukio Ito et al, filed on Apr. 26, 1977 under the title "TAPE WINDING ARRANGEMENT FOR PAPER BUNDLE BINDING APPARATUS" which corresponds to Japanese Patent Application No. 47210/1976 and has been assigned to the same assignees as the present application. Besides, the aforementioned tape winding apparatus may also be constructed similar to the one disclosed in copending U.S. Patent Application Ser. No. 789,279 of Yukio Ito et al, filed on Apr. 20, 1977 under the title of "BINDING TAPE DEALING APPARATUS FOR PAPER BUNDLE BINDING APPARATUS" which corresponds to Japanese Patent Application No. 47209/1976 and has been assigned to the same assignees as the present application. Accordingly, for any further information about these apparatuses, reference should be made to the above described U.S. Patent Applications, if necessary.

The present invention is primarily directed to the arrangement for clamping or pressing the loaded or charged paper stack thereby holding it in a secured and compacted state before and during the tape winding operation.

Referring to FIGS. 1 and 2, the paper stack or bundle clamping apparatus 10 comprises first and second receiving base plates or platforms 11 and 13. The first receiving platform 11 has an arcuately concaved portion **11*c* and flat edge portions 11*a* and 11*b* formed in the upper surface. In a similar manner, the second receiving platform 13 is also formed with an arcuately concaved portion as well as flat edge portions 13*a* and 13*b* formed in the upper surface. It should be noted that the first and second receiving platforms 11 and 13 are longitudinally aligned with each other with a free space S interposed therebetween. The width of the space S is selected to be greater than that of the binding tape 18 so that the binding tape 18 can pass through the space during the winding operation. A receiving plate 15 is fixedly secured to the second platform 13 at the end portion thereof opposite the space or gap S. The receiving plate 15 is formed of a resilient material and extends across the space S over the first and the second platforms 11 and 13 in contact therewith. Disposed above the receiving plate 15 is a clamping member 17 which is fixedly secured to a vertically movable supporting block 19 and is formed with a pressing plate pad 23. Although the upper surface of the pressing pad 23 is flat, the lower surface is of an arcuately convexed form in cross-section. The thickness of the pressing pad 23 is selected greater than that of an arm portion (FIG. 3) so that the pad 23 can be advantageously used for pressing together the paper stack, as will be described hereinafter. A pair of link members 27 and 31 are swingably mounted on the supporting block 19 parallel with each other. In more particular, the link member 27 is pivotally connected to the supporting block through a shaft 27*a* at one end and at the same time is fixedly secured to a stationary block 33 through a shaft or stud 27*b* at the other end. The link member 31 is longer than the link 27 and has one end portion connected to the supporting block 19 through a shaft 31*a* and an intermediate portion rotatably connected to the stationary block 33 through a shaft 31*b*. The other end portion of the link member 31 is pivotally connected to one end of a lever 35 through a pin 31*c*, which lever 35 in turn is pivotally connected to another lever 37 through a pin 35*a*. The lever 35 is constantly subjected to a pulling force of a spiral spring 39. The lever 37 is swingably connected to a stationary shaft 37*a* at the other end. A roller 41 is mounted on the shaft 35*a* at one end. One end portion of a lever 43 is in contact with the roller 41. In this manner, the levers 35, 37 and 43 cooperate with one another to constitute a toggle mechanism. The lever 43 is swingably mounted on a stationary shaft 45. The lever 43 is provided with a cam follower 47 at an intermediate portion thereof which is adapted to engage a cam 49. Reference numeral 14** denotes a stack of paper sheets such as paper money to be bound.

With the arrangement of the clamping apparatus described above, the paper stack 14 to be clamped by this apparatus is slidably guided over the arcuately concaved portion 11*c* of the first platform 11 and placed on the receiving plate 15. As can be seen from FIGS. 3 and 5, the first platform 11 is formed with a recess or offset face 11*d* for receiving the free end portion of the resilient receiving plate 15, which thus provides no obstacle to the charging or feeding of the paper stack 14. When the paper stack has been placed at a predetermined position, the lever 43 is actuated by the cam 49 by way of the cam follower 47. The movement of the lever 43 is doubled through the lever 35 and parallel links 27 and 31 to be transmitted to the supporting block 19. This results in the lowering of the pressing plate pad 23, whereby the paper stack 14 is clamped by the convexed lower surface 23*a* of the pad 23. It will be appreciated that the paper stack 14 as well as the resilient plate 15 is bent or curved arcuately in the clamped or pressed state. Then, the flyer 6 is rotated along the path 51 thereby winding the binding tape 18 around the clamped paper stack. The state in which the binding tape 18 is wound is illustrated in FIGS. 3 and 4. As can be seen from these figures, the receiving plate 15, the paper stack 14 and the pressing pad plate 23 are wound together by the binding tape 18. Subsequently, a pad 29 (FIG. 1) is positioned so as to bear on the tape 18 on the pad plate 23, whereby the tape 18 is bonded. Upon withdrawing the bound paper bundle 14 after the bonding, the pad plate 23 is lifted a a slight distance as shown in FIG. 5 under the control through the cam 49 (FIG. 2). At that time, the underlying receiving plate 15 is also raised, because the tape 18 is wound around both the receiving plate 15 and the pad plate 23 which is being raised, and the paper bundle or stack 14 as bound is released from the clamping force. It is thus possible to withdraw readily the bound paper stack 14 from between the pad 23 and the plate 15. The withdrawn paper bundle 14 tends to restore the original flat configuration from the bent or curved state. By virtue of this restoring tendency of the paper bundle, tension is applied to the wound tape 18 and hence to the bound paper stack.

As will be appreciated from the foregoing description, a stack of paper sheets can be fixedly and positively bound by the binding tape according to the teachings of the invention, since the paper stack distorted into a curved or bent configuration under the clamping force during the tape winding operation will tend to restore to its original linear configuration, whereby the binding tape wound around the paper stack is tensioned. Further, due to such arrangement that the clamping member is connected to the toggle mechanism through the parallel links, a great clamping force can be produced with a simple and rigid construction. Besides, the pressing pad 23 serves not only as the clamping means but also as the back-up means for the tape bonding operation. This feature also contributes to a simplified structure of the apparatus.

The present invention has thus proposed a clamping apparatus which is capable of imparting tension to a paper bundle or stack bound by the binding tape and which can be implemented inexpensively in a simple and rigid structure.

Although a preferred embodiment of the invention has been shown and described above, many modifications and variations will readily occur to those skilled in the art without departing from the spirit and scope of the invention as defined by the appended claims.

What we claim is:

1. A compressing device for use in an apparatus for binding stacks of paper sheets with a binder tape, said compressing device comprising:

a first platform, at least a portion of the upper surface of said first platform being arcuately concaved;

a second platform longitudinally aligned with said first platform in the same plane and separated from said first platform by a gap, said second platform having at least a portion of the upper surface thereof arcuately concaved;

a resilient receiving plate means connected to said second platform and extending over said concave surface portions of both of said platforms and across said gap for receiving said paper sheets thereon; and a pressure pad plate above said receiving plate means reciprocally movable toward and away from said receiving plate means, said pressure pad plate having a lower surface which is arcuately convexed.

2. A device as claimed in claim 1, wherein the upper surface of said pressure pad plate is at least partially flat.

3. A device as claimed in claim 1, further comprising cam and link means connected to said pressure pad plate for reciprocally moving said pressure pad plate toward and away from said receiving plate means.

4. A device as claimed in claim 1, wherein:

said first platform has a recess in the concave surface thereof at the end adjacent said gap; and said receiving plate means is fitted into said recess.

5. A device as claimed in claim 1, wherein said first and second platforms have flat, longitudinal edges on each side of said concaved portion.

* * * * *